US005364084A

United States Patent [19]

Karash

[11] Patent Number: 5,364,084

[45] Date of Patent: Nov. 15, 1994

[54] CARPENTER'S TOE-NAIL BACKUP CLAMP

[75] Inventor: L. Stanley Karash, Hastings, Nebr.

[73] Assignee: Karding, Inc., Grand Island, Nebr.

[21] Appl. No.: 119,971

[22] Filed: Sep. 9, 1993

[51] Int. Cl.[5] ..... B25B 5/14

[52] U.S. Cl. ..... 269/41; 269/236; 269/904; 269/315

[58] Field of Search ..... 269/41, 42, 152–155, 269/236, 904, 315

[56] References Cited

U.S. PATENT DOCUMENTS

| | | | |
|---|---|---|---|
| D. 261,609 | 11/1981 | Roux | 269/236 |
| 630,900 | 8/1899 | Kohl | 269/236 |
| 2,680,459 | 6/1954 | Dodson et al. | 269/236 |
| 2,956,798 | 10/1960 | Briggs | 269/904 |
| 3,083,007 | 3/1963 | Campfield | 269/904 |
| 3,914,871 | 10/1975 | Wolff | 269/41 |
| 4,589,640 | 5/1986 | Pert | 269/236 |
| 4,795,141 | 1/1989 | Mulvaney | 269/236 |
| 4,888,879 | 12/1989 | Dixon | 269/904 |

*Primary Examiner*—Robert C. Watson
*Attorney, Agent, or Firm*—Head & Johnson

[57] ABSTRACT

A carpenter's toe-nail backup clamp for use in positioning a first board, such as a 2×4 wall stud, to a second board, such as a 2×4 plate, to facilitate attaching the first board to the second board with nails, the backup clamp having a base member to rest on the second board, an end plate affixed to one end of the base member for extending along one edge of the second board, a cam member secured to the base member at the other end thereof about an axis that is parallel to the end plate, the cam member providing variable spacing from the end plate according to the rotational position of the cam member, and a handle extending from the cam member by which the cam member can be rotated to clamp the second board between the cam member and the backup plate, the base member thereby providing a backup for a first board so that the first board may be toe-nailed to the second board.

5 Claims, 4 Drawing Sheets

CARPENTER'S TOE-NAIL BACKUP CLAMP

BACKGROUND OF THE INVENTION

Most residential structures built in the United States, Canada and other countries of the world where ample wood supplies exist are constructed of dimensional lumber. The interior and exterior walls of typical houses are formed of 2×4's or 2×6's. Typically, a wall is formed with a horizontal base plate that rests upon a floor or foundation and a horizontal upper plate that defines the height of the wall, with spaced apart vertical studs extending between the base and top plates. Sometimes, a wall is constructed in a horizontal position and then tilted or lifted up into its vertical position. When constructed in a horizontal position nails can be driven through the plates directly into the ends of the studs. Walls constructed in this manner have the limitation that the top and bottom plates can be easily pulled away from the studs since nails driven into the ends of the studs have low holding power. In many instances it is necessary and, in fact, is usually desirable that a stud be affixed to a bottom or top plate by toe-nailing the stud to the plate. Toe-nailing provides a better system of attachment of a stud to a plate in that the angular extension of nails between the stud and the plate resists attempts to pull the stud away from the plate.

One problem with toe-nailing studs to upper and lower plates is that of accurately positioning the stud with respect to the plate. Since nails must be driven from one side of a vertically extending stud it is easy to see that the position of the stud on the bottom or top base plate can be easily moved during the process of hammering the nails into position. This invention concerns a carpenter's toe-nail backup clamp that can be quickly secured to a top or bottom plate and to form a backup against which a stud may be positioned so that it may be toe-nailed to the plate in a preselected, accurate position.

The use of a carpenter's toe-nail backup clamp of this invention for securing vertical studs to a top or bottom plate is only one example of the application of the invention. The carpenter's toe-nail backup clamp may be used on vertical studs to locate horizontal members, such as for framing windows. These are merely examples of the application of the carpenter's toe-nail backup clamp as will be described.

SUMMARY OF THE INVENTION

A carpenter's toe-nail backup clamp is provided for use in positioning a first board at right angles to a second board. While not so limited, an example of the use of the carpenter's toe-nail back up clamp is to position a vertical stud against a horizontal bottom plate or top plate in residential-type frame construction. In this application, the backup clamp is attached to a second board, such as a horizontal plate, for use in toe-nailing a first board, such as a vertical stud, to the second board.

The backup clamp includes a base member having a longitudinal axis, a first end, a second end, a top and a bottom surface. An end plate is affixed to the base member first end and extends normal to the base member longitudinal axis and below the base member bottom surface.

A cam member is rotatably secured to the base member bottom surface at the second end thereof. The cam member is rotatable about an axis that is parallel to the end plate. The cam member has a cam surface that provides variable spacing from the end plate according to the rotational position of the cam member.

A elongated handle is secured to the cam member for rotating the cam member.

When the base member is supported with its bottom surface on a second board, such as a bottom plate, and with a longitudinal axis of the base member extending perpendicular to the length of the second board, the cam may be rotated by rotating the handle to clamp the base member onto the second board. That is, the second board is clamped between the end plate and the cam member.

When in such clamped position, the base member extends across the second board at right angles thereto relative to the length of the board, and forms a member against which a first board, such as a vertical stud, may be positioned. When so positioned, the first board may then be toe-nailed into the second board.

The carpenter's toe-nail backup clamp thus provides for securely positioning a first board to extend at right angles to a second board so that the first board may be nailed to the second board in an accurately selected position.

In a preferred embodiment of the invention an elongated spacing member is secured to and extends from the backup clamp base member and serves to locate other building structural members. For instance, in assembling a frame wall, the spacing member can be used to accurately space studs as they are nailed in position between top and bottom plates.

A better understanding of the invention will be had by reference to the following description of the preferred embodiment, taken in conjunction with the claims and in view of the attached drawings.

DESCRIPTION OF THE PREFERRED EMBODIMENTS

Figure 7:
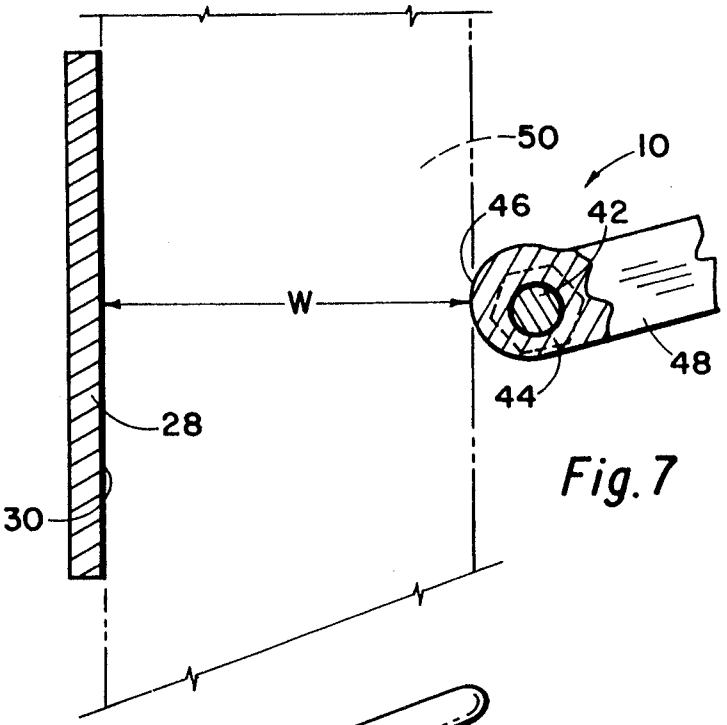
FIG. 7 is a cross-sectional view taken along the line 7—7 of FIG. 6 showing the backup clamp as it is positioned on a board that is shown in phantom outline and illustrating the method by which the cam surface of the cam member is used to vary the spacing between the cam member and the end plate to illustrate the manner in which the backup clamp is secured to a board.
Figure 5:
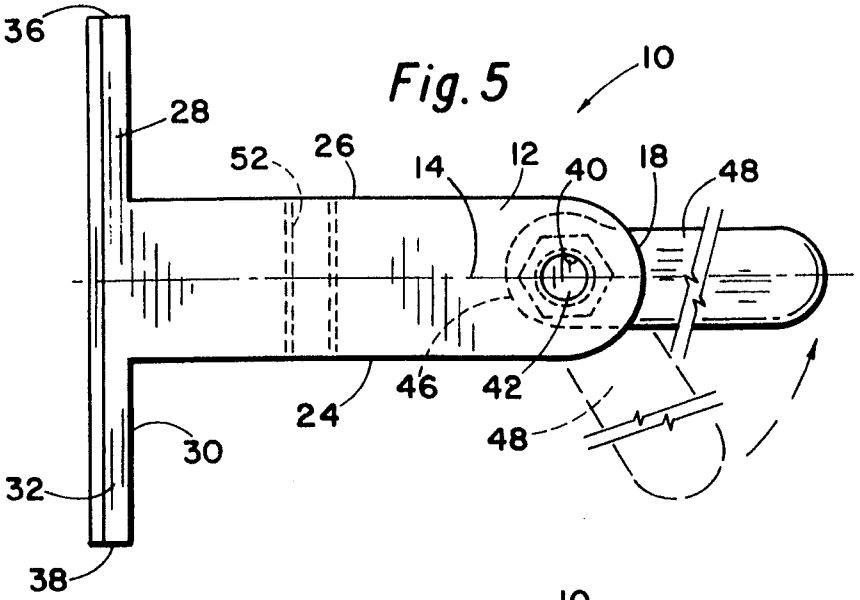
FIG. 5 is a plan view of the backup clamp with the cam operating handle broken away.
Figure 6:
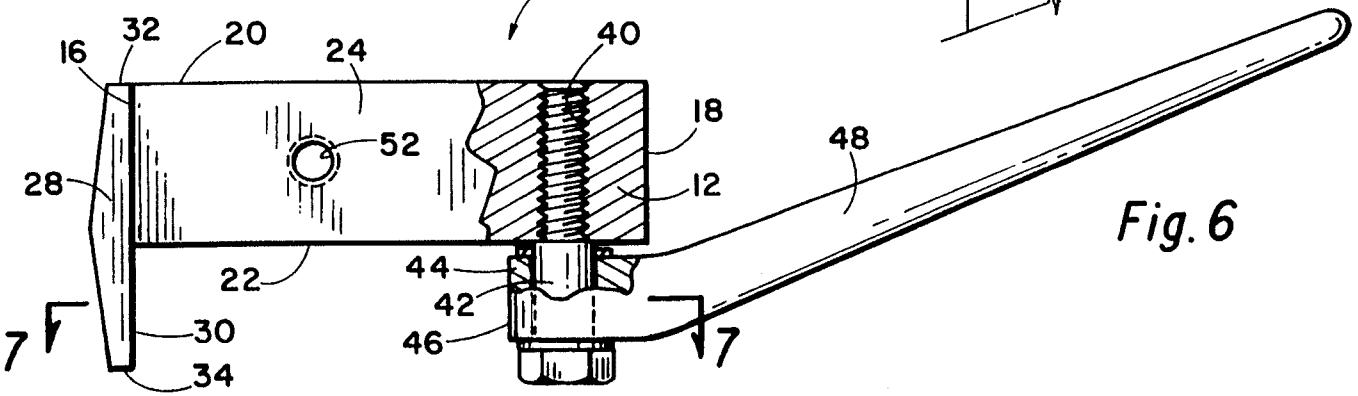
FIG. 6 is an elevational view of the backup clamp shown partially broken away to show how the cam member is mounted.

Referring first to FIGS. 5, 6 and 7, the basic elements of the carpenter's toe-nail backup clamp are illustrated. The backup clamp is indicated generally by the numeral 10 and includes a base member 12 having a longitudinal axis 14. The base member 12 has a first end 16, a second end 18, a top surface 20, a bottom surface 22, a first sidewall 24 and a second sidewall 26.

Affixed to the base member first end 16 is an end plate 28. In the illustrated and preferred arrangement, end plate 28 and base member 12 are integrally formed, that is, they are machined or cast as one piece. The end plate extends normal to the base member longitudinal axis 14. More specifically, the end plate has an inner surface 30 that is perpendicular to the base member longitudinal axis 14.

End plate 28 has a top edge 32 and a bottom edge 34. The height of the end plate is greater than that of base member 12 so that the bottom edge 34 extends below the base member bottom surface 22. Further, the end plate 28 has first and second ends 36 and 38 that are spaced apart further than the base member sidewalls 24 and 26.

A threaded opening 40 is formed in the base member adjacent the second end 18 and receives the threaded portion of a bolt 42.

Rotatably received on bolt 42 is a cam member 44. Cam member 44 has a cam surface 46 that is at a variable radius from bolt 42.

Integrally extending from cam 44 is a handle 48. In the illustrated and preferred arrangement, handle 46 and cam member 44 are integrally formed, although it can be seen that these could be formed of separate elements. The function of handle 48 is to rotate cam member 44, although it can be seen that other means can be provided for the rotation of the cam member.

FIG. 7 shows, in phantom outline, a board 50 as would appear with a backup clamp positioned on the board. In FIG. 6 a board 50 is not shown. The cam surface 46 provides a variable spacing "W", as seen in FIG. 7, between inner surface 30 of end plate 28 and cam surface 46. FIG. 7 illustrates the manner by which the backup clamp can be securely clamped to a board 50 by the rotation of handle 48 to vary the spacing "W".

As seen in FIGS. 5 and 6, base member 12 has a threaded opening 52 therein positioned between the base member first and second ends 16 and 18 and extending between the base member first and second sidewalls 24 and 26. The function of threaded opening 52 will be described subsequently.

Figure 1:
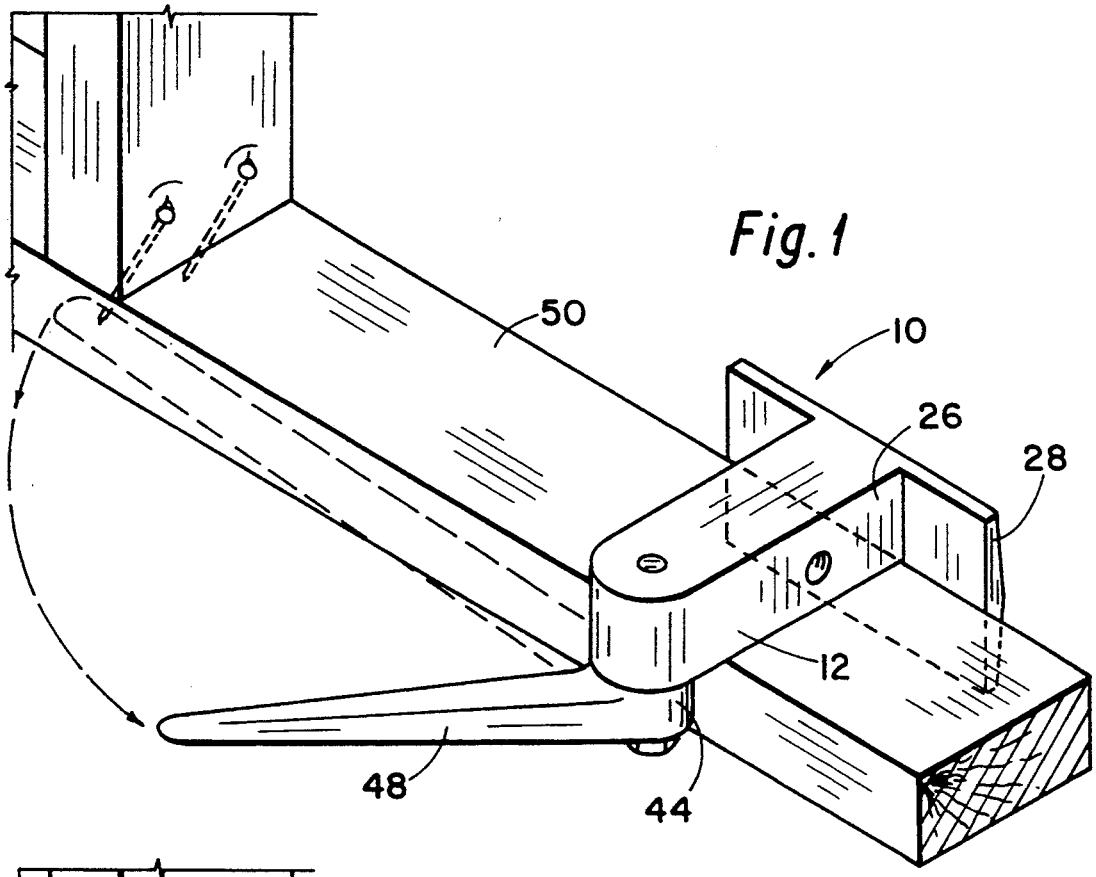
FIG. 1 is an isometric view of the carpenter's toe-nail backup clamp shown in position on a horizontal board, such as a wall plate, as it is used to position a first board to be attached to the horizontal board.
Figure 2:
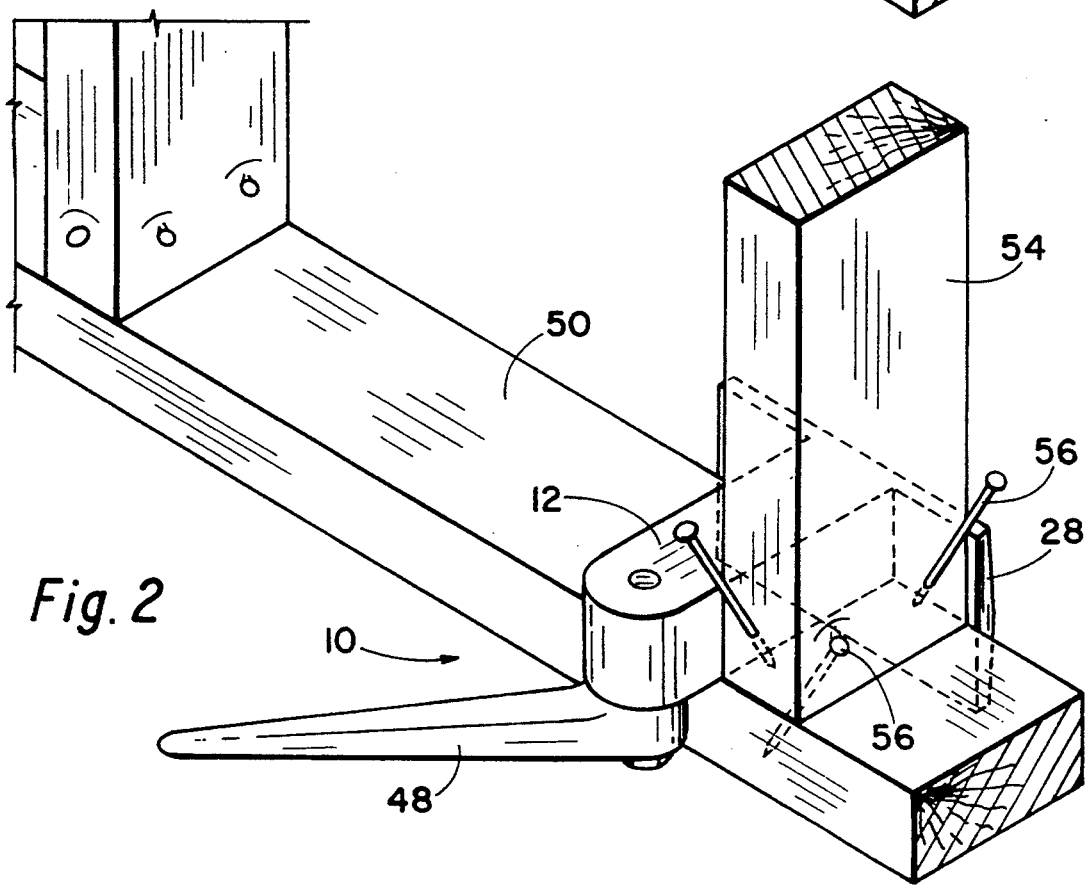
FIG. 2 shows a first board, such as a wall stud resting on a bottom plate and retained in secure position by the backup clamp.

Referring now to FIGS. 1 and 2, a typical example of the application of the carpenter's toe-nail backup clamp is illustrated. The function of the clamp is to enable a carpenter to more efficiently and accurately secure a first board, such as a vertical stud 54 as seen in FIG. 2, to a second board 50, such as a bottom plate as is typically encountered in the construction of a wall. FIG. 1 shows the backup clamp 10 secured in position on second board 50 with base member 12 extending at right angles to the length of the board. More specifically, the base member second sidewall 26 extends perpendicular to the length of board 50. When handle 48 is moved from the dotted to the solid outline position, the cam surface of cam member 44 securely locks the backup clamp into position on board 50. In such secure position, first board 54 is positioned on second board 50 and against base member second sidewall 26. In such position, nails 56 can be driven through the lower end of first board 54 and into second board 50. The procedure of driving nails at an angle as illustrated in FIG. 2 is referred to as "toe-nailing" first board 54 to second board 50.

After the nails are driven, as illustrated in FIG. 2, the carpenter can remove backup clamp 10 and then drive nails in the other side of first board 54 which will be held in a secure position by nails 56 or if the carpenter wants to make certain that the first board 54 does not move relative to the second board, the clamp can be placed on the opposite side of the first board and clamped into position while a second set of nails is driven from the opposite side of first board 54. A nail 57 can also be driven into the leading edge of stud 54. End plate 28 serves to hold stud 54 position as nail 57 is driven into the stud.

It can be seen with reference to FIGS. 1 and 2 that clamp 10 can be very expeditiously secured to second board 50 and removed when the nailing procedure is completed merely by rotation of handle 48.

Figure 3:
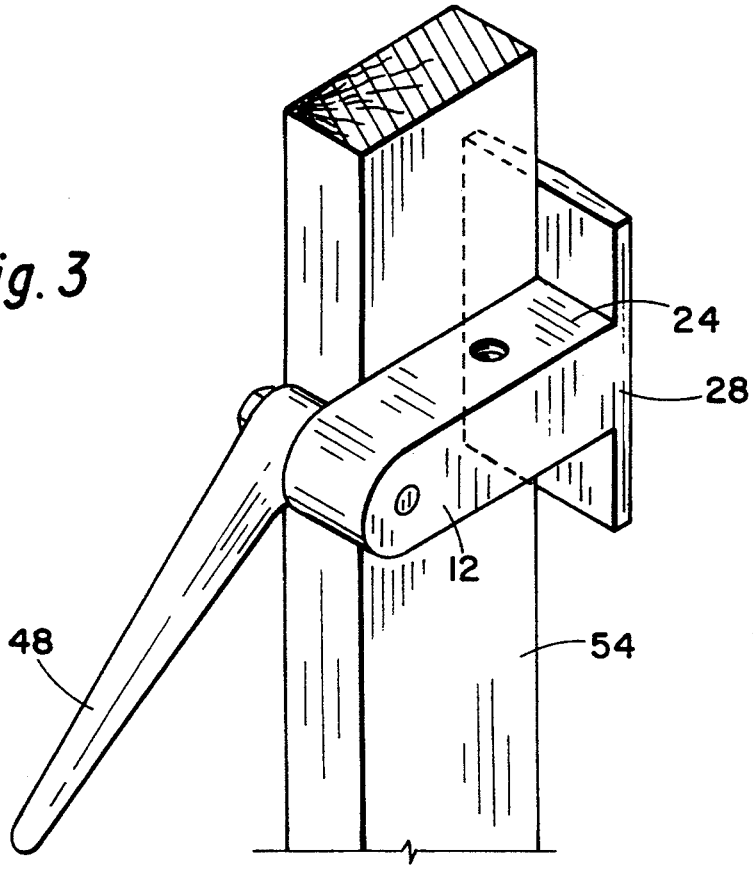
FIG. 3 is an isometric illustration of the carpenter's toe-nail backup clamp as used on a vertical board, such as a wall stud, as may be used for attaching a horizontal board (not shown) to the vertical stud.

FIG. 3 illustrates the use of the carpenter's toe-nail backup clamp 10 on a vertical first board 54. The backup clamp base member second surface 26 provides a horizontal support surface on which a horizontal board (not shown) may be positioned, such as for use in framing a window opening or the like.

Figure 4:
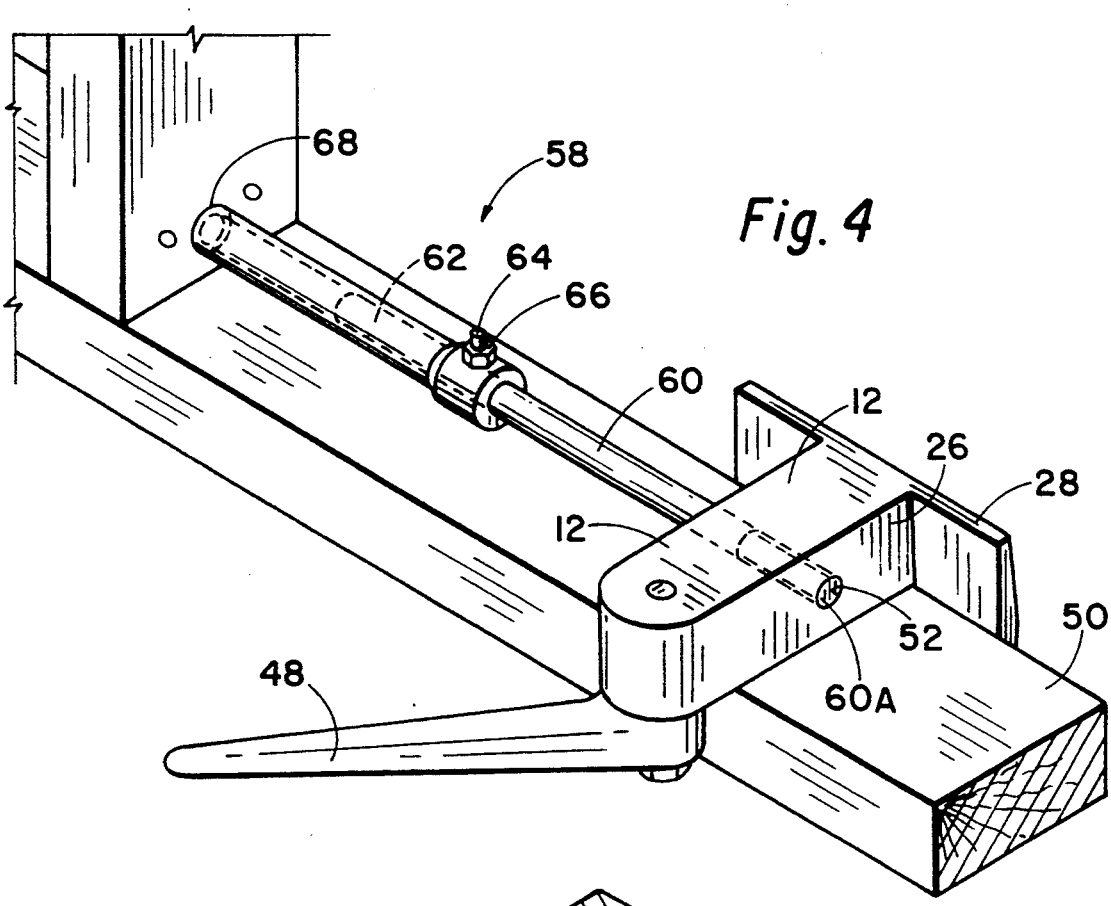
FIG. 4 is an isometric view as shown in FIG. 1 but showing use of a spacing member that is secured to the backup clamp. The backup clamp with the spacing member is an alternate embodiment of the invention.

FIG. 4 shows an alternate embodiment of the backup clamp. In this embodiment, an elongated spacer member generally indicated by the numeral 58 is employed. In this illustrated embodiment spacer member 58 has a first shaft portion 60 having a threaded inner end 60A that is threadably positioned within the threaded opening 52 in the backup clamp base member 12. Telescopically received on shaft 60 is a tubular member 62. The position of the tubular member on shaft 60 is set by a threaded stud 64 and secured by a nut 66. By adjusting tubular portion 62 the spacing between the outer end 68 and the base member first surface 24 can be adjusted. In this way, the spacing between adjacent studs 54 can be automatically positioned without requiring the carpenter to measure and lay out the spacing. The spacing between studs can be changed by loosening nut 66 and threaded stud 64 to adjust the position of tubular member 62.

Figure 8:
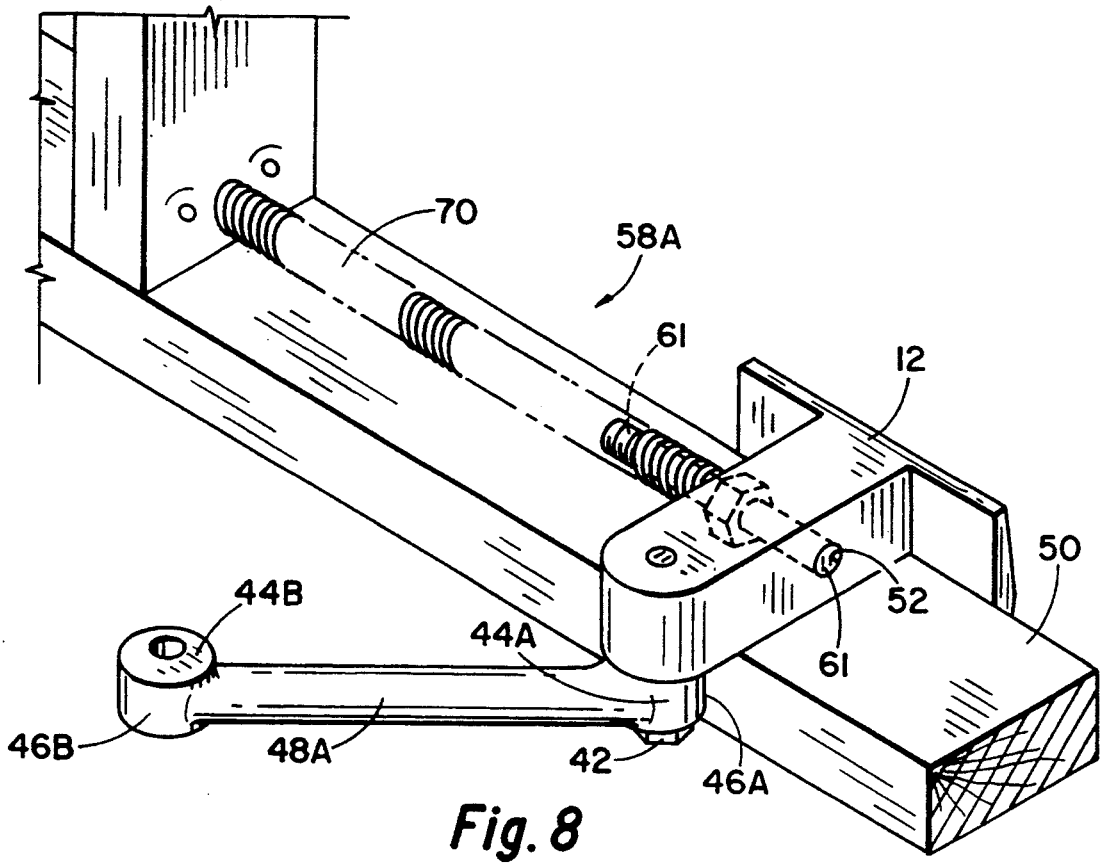
FIG. 8 is an isometric view of an alternate embodiment of the toe-nail backup clamp similar to the view of FIG. 4 but showing an alternate embodiment of the handle having a cam portion on each end. This figure also shows an alternate embodiment of the spacer member or gauge.
Figure 9:
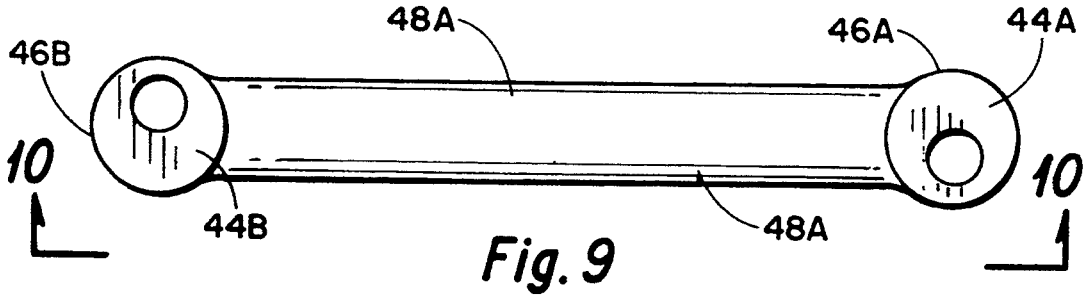
FIG. 9 is a plan view of the alternate embodiment of the handle with cam portions on each end.
Figure 10:
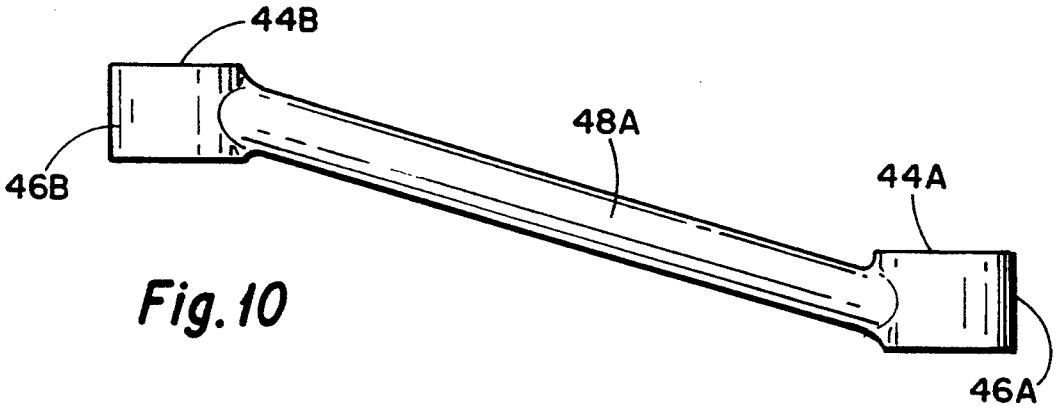
FIG. 10 is an elevational view taken along the line 9—9 of the improved handle.

FIGS. 8, 9 and 10 show an alternate embodiment of the handle cam member configuration. FIG. 9 is a plan view of a handle 48A having a cam member portion 44A on one end and 44B on the other end. The cam member portion 44A has a cam surface 46 and in like manner, cam member portion 44B has a cam surface 46B. These cam surfaces are opposite to each other so that the ends of the handle 48A may be switched and when switched reverse the direction that the handle is moved with respect to the board to which it is applied. For instance, referring to FIG. 8, when handle 48A is secured in the position illustrated so that the cam member 44A is rotated around bolt 42, handle 48 is rotated clockwise when looking down on space member 12 to tighten the backup clamp onto board 50. If the handle was reversed so that cam member portion 44B rotated around bolt 42, the handle would be rotated counterclockwise to tighten it on board 50. This is so because of the off-set of the cam portions 44A and 44B to the length of the handle, as seen in the elevational view of FIG. 2, which means that as the ends of the wrench are reversed the wrench is also inverted. The advantages of the improved handle of FIGS. 8, 9 and 10 is that if the backup clamp is used in a spot where it is difficult or impossible to rotate the handle in one direction to tighten the clamp, the handle can be reversed so that it can be rotated in the other direction for tightening.

FIG. 8 shows an alternate embodiment of the elongated spacer member, generally indicated by the numeral 58A. In this embodiment, the spacer member has a first shaft portion 61 that is received in opening 52 in backup clamp base member 12. Telescopically received on shaft 61 is a tubular coil spring 70. The length of the spring is established so that the desired spacing between studs can be achieved. The spacer member 58A functions in the same way as the spacer member 58 previously described except that the spring member portion 70 can be bent out of the way for convenience when placing studs closer together.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A carpenter's toe-nail backup clamp for use in positioning a first board at right angles to a second board to facilitate attaching the first board to the second board with nails, comprising:

a base member formed of a solid block of metal having a longitudinal axis, a first end, a second end, sides, a top surface and a bottom surface which rests upon said second boards, said base member extending substantially upward from said bottom surface to said top surface whereby a relative large flat surface area and mass extends from said first to said second end to provide substantial planar backup surface with said first board;

an end plate integrally affixed to said first end of said base member and extending from said top surface transversely outward on both sides of said base member, and extending below said base member;

a cam member secured to said base member bottom surface at said second end thereof and rotatable about an axis that is parallel to said end plate, the cam member having a cam surface that provides variable spacing from said end plate according to the rotational position of the cam member; and an elongated handle attached to said cam member for rotating said cam member whereby a second board may be grasped between said end plate and said cam member with said base member resting on and extending across the second board to provide a clamped backup against which said first board may be positioned.

2. A carpenter's toe-nail backup clamp according to claim 1 including:

an elongated spacing member having an inner end and an outer end, the inner end being removably affixed to said base member at a location intermediate said base member first and second ends and extending perpendicular to said base member longitudinal axis and parallel to said end plate, the outer end of the spacing member being useable for locating a third board to be secured to the second board at a fixed distance relative to said first board.

3. The backup clamp of claim 2 wherein said spacing member is adjustable in its length.

4. A carpenter's toe-nail backup clamp for use in positioning a first board at right angles to a second board to facilitate attaching the first board to the second board with nails, comprising:

a base member having a longitudinal axis, a first end, a second end, a top and a bottom surface;

an end plate affixed to said base member first end and extending normal to said base member longitudinal axis and extending below said base member bottom surface;

a cam member secured to said base member bottom surface at said second end thereof and rotatable about an axis that is parallel to said end plate, the cam member having a cam surface that provides variable spacing from said end plate according to the rotational position of the cam member; and an elongated handle integrally formed with said cam member for rotating said cam member whereby a second board may be grasped between said end plate and said cam member with said base member resting on and extending according the second board to provide a backup against which a first board may be positioned; and said elongated handle has a cam member at each end thereof, the cam members being reverse oriented so that the backup clamp can be tightened on a board by rotating said handle in one direction when employing one cam member and rotating said handle in the opposite direction when employing the other of said cam members.

5. A carpenter's toe-nail backup clamp for use in positioning a first board at right angles to a second board to facilitate attaching the first board to the second board with nails, comprising:

a base member having a longitudinal axis, a first end, a second end, a top and a bottom surface;

an end plate affixed to said base member first end and extending normal to said base member longitudinal axis and extending below said base member bottom surface;

a cam member secured to said base member bottom surface at said second end thereof and rotatable about an axis that is parallel to said end plate, the cam member having a cam surface that provides variable spacing from said end plate according to the rotational position of the cam member; and means of rotating said cam member whereby a second board may be grasped between said end plate and said cam member with said base member resting on and extending across the second board to provide a backup against which a first board may be positioned;

an elongated spacing member having an inner end and an outer end, the inner end being affixed to said base member at a location intermediate said base member first and second ends and extending perpendicular to said base member longitudinal axis and parallelled to said end plate, the outer end of the spacing member being useable for location of building structural members to be secured to the second board; and wherein said elongated spacer member is formed of a coiled spring that normally extends straight from said base member but that can be bent out of the way for convenience when placing a building structural member closer than the normal spacing.

* * * * *